US007975766B2

(12) United States Patent
Churchill

(10) Patent No.: US 7,975,766 B2
(45) Date of Patent: Jul. 12, 2011

(54) TOP FILLING TUBING

(75) Inventor: Andrew Phillip Churchill, Cove (GB)

(73) Assignee: Churchill Drilling Tools Limited, Aberdeen (GB)

( * ) Notice: Subject to any disclaimer, the term of this patent is extended or adjusted under 35 U.S.C. 154(b) by 116 days.

(21) Appl. No.: 12/304,732

(22) PCT Filed: Jun. 11, 2007

(86) PCT No.: PCT/GB2007/002172

§ 371 (c)(1), (2), (4) Date: May 4, 2009

(87) PCT Pub. No.: WO2007/144597

PCT Pub. Date: Dec. 21, 2007

(65) Prior Publication Data

US 2010/0012324 A1 Jan. 21, 2010

(30) Foreign Application Priority Data

Jun. 14, 2006 (GB) ..... 0611711.3

(51) Int. Cl.
*E21B 19/00* (2006.01)

(52) U.S. Cl. ..... 166/312; 166/374; 166/90.1

(58) Field of Classification Search ..... 166/312, 166/374, 90.1
See application file for complete search history.

(56) References Cited

U.S. PATENT DOCUMENTS

| | | | | |
|---|---|---|---|---|
| 6,173,777 | B1 | 1/2001 | Mullins | |
| 2003/0217843 | A1 * | 11/2003 | Mullins | 166/90.1 |
| 2005/0000695 | A1 * | 1/2005 | LaFleur | 166/373 |

* cited by examiner

*Primary Examiner* — William P Neuder
(74) *Attorney, Agent, or Firm* — The Oathout Law Firm

(57) ABSTRACT

A method of top-filling a drill pipe string comprises injecting fluid into the upper end of the string. Apparatus for use in top-filling a drill pipe string comprises an injector adapted to co-operate with the upper end of a drill pipe string, whereby fluid may be pumped through the injector and into the string.

31 Claims, 5 Drawing Sheets

TOP FILLING TUBING

FIELD OF THE INVENTION

This invention relates to the top filling of tubing, such as the tubing used in drilling operations.

BACKGROUND OF THE INVENTION

In the oil and gas industry, bores are drilled to access subsurface hydrocarbon-bearing formations. The bores are drilled using bits forming parts of bottom hole assemblies (BHAs) mounted on the ends of strings of drill pipe. The drill pipe string comprises a number of drill pipe lengths which are stored on surface as "stands", each stand comprising three lengths of drill pipe. Each length of drill pipe comprises a relatively thin-walled central portion and much thicker-walled end connectors which define smaller internal diameters (typically 3-3½") and larger outer diameters. As a drill string is advanced into a bore new stands of pipe are added to the upper end of the string.

The drilled bore is typically filled with drilling fluid or mud. Thus, as the drill string is made up and lowered into the bore, the fluid surrounds the drill pipe. The majority of drill strings are adapted such that the fluid may flow into the hollow string as it passes into the fluid-filled bore, that is the string is "self-filling". However, in some circumstances the drill string is not self-filling and must be top-filled, due to the presence of a non-return valve in the string: in the absence of fluid in the string, the external hydrostatic pressure may reach a level sufficient to crush or collapse the hollow drill string.

Conventionally, a drill string will be top-filled after ten drill pipe stands have been run into the bore. This is achieved by trickling drilling fluid into the open upper end of the string. This top-filling operation is tricky and potentially messy, with spillage of drilling fluid being common. Also, top-filling ten stands of pipe typically takes between five and ten minutes, and additional time will often be required to clean-up any spills.

The drilled bore is subsequently lined with tubing, known as casing, which must be top-filled as it is run into the bore. However, top-filling casing is generally far easier than top-filling drill pipe, due to the significantly larger internal diameter of the casing (typically 8½-17½"), facilitating flow of the displaced air from the casing. Also, the internal diameter of casing is constant over the length of the casing string and does not feature any internal restrictions.

The subsequent bore-lining step involves running tubing, known as liner, and suspending the liner from the lower end of the casing. The liner is run into the bore on drill pipe and is provided with a non-return valve at its leading end. Thus, the liner and supporting drill pipe string require top-filling.

SUMMARY OF THE INVENTION

According to the present invention there is provided a method of top-filling a drill pipe string, the method comprising injecting fluid into the upper end of the string.

According to another aspect of the present invention there is provided apparatus for use in top-filling a drill pipe string, the apparatus comprising an injector adapted to co-operate with the upper end of a drill pipe string, whereby fluid may be pumped through the injector and into the string.

Injecting the fluid into the upper end of the drill pipe allows the fluid to be pumped into the drill string at a higher flow rate than if the fluid was simply poured or trickled into the string. Typically, the fluid will be injected in one or more relatively high velocity streams having a cross-sectional area significantly smaller than the smallest restriction at the upper end of the drill pipe string. Alternatively, a fluid jet or curtain may be configured to flow down the wall of the drill pipe.

Preferably the injected fluid configuration is selected such that air displaced from the drill string may pass readily through the open upper end of the string without disrupting the flow of injected fluid into the string, thus avoiding splashing and the like which limits the flow rate of fluid into the drill pipe in a conventional arrangement. Temporary or intermittent disruption of the fluid flow by displaced air which occurs a distance from the upper end of the drill string is of little, if any significance, as any splashing is contained within the pipe and any temporary flow interruptions are readily accommodated in the internal volume of the drill pipe.

The apparatus may include a nozzle or other arrangement adapted to form a jet of fluid to be directed into the drill pipe. The nozzle may have an outlet adapted for location above or adjacent the open upper end of the drill pipe string. In an alternative arrangement, the apparatus may include a fluid guide configured for extending into the upper end of the string. The guide may take the form of a tube or spout. The tube may be of sufficient length to extend through the throat or restriction which is typically present towards the end of a section of drill pipe. The tube may be adapted to be located centrally of the drill string.

The apparatus may be configured to direct fluid downwards in an axial direction, parallel to the drill string axis. Alternatively, the fluid flow path may be inclined to the string axis, and may be directed such that the fluid flows downwards following a helical path around the upper surface of the drill string.

The apparatus may be adapted for mounting to a top drive apparatus or other structure. The apparatus may be adapted for mounting to and demounting from a top drive, for example the apparatus may define a female thread or other thread-engaging arrangement for co-operation with a male threaded portion of a top drive. Alternatively, or in addition, the apparatus may include a male portion for extending into the open end of a top drive apparatus. The ability of the apparatus to be mounted to a top drive unit obviates the need to provide a dedicated mounting structure for the apparatus, and allows the existing fluid pumps and conduits which are typically available to supply fluid through the top drive to be used to fill the drill string.

The apparatus may be adapted to be fixed in location at the upper end of the drill string by trapping or otherwise securing at least a part of the apparatus between the top drive and the upper end of the string.

Alternatively, the apparatus may be deck-mounted or provided on a unit adapted to be fixed on the rig, or a deck-mounted unit of a mass sufficient to resist any flow-related forces acting on the apparatus. In some embodiments, the apparatus is adapted for use without requiring coupling or positive engagement with the drill string, and in some embodiments the apparatus may be adapted for use without the apparatus contacting the drill string. Thus, it is not necessary to couple and uncouple the apparatus to the drill string.

The volume of fluid necessary to fill the drill string to a desired level may be determined, and the determined volume of fluid pumped into the string.

In accordance with the another aspect of the invention there is provided a method of top-filling a drill pipe string, the method comprising providing a defined flow path for fluid to flow into or from an upper end of a drill pipe string.

The invention further relates to apparatus for use in top-filling a drill pipe string, the apparatus comprising means for defining a fluid flow path into or from an open upper end of a drill pipe string.

By defining a flow path for one or both of the fluid flowing into the drill pipe string and the displaced air flowing from the string, it is possible to fill the drill string relatively quickly as the oppositely directed flows will not tend to interfere with one another.

BRIEF DESCRIPTION OF THE DRAWINGS

These and other aspects of the invention will now be described, by way of example, with reference to the accompanying drawings, in which.

DETAILED DESCRIPTION OF THE DRAWINGS

Figure 1:
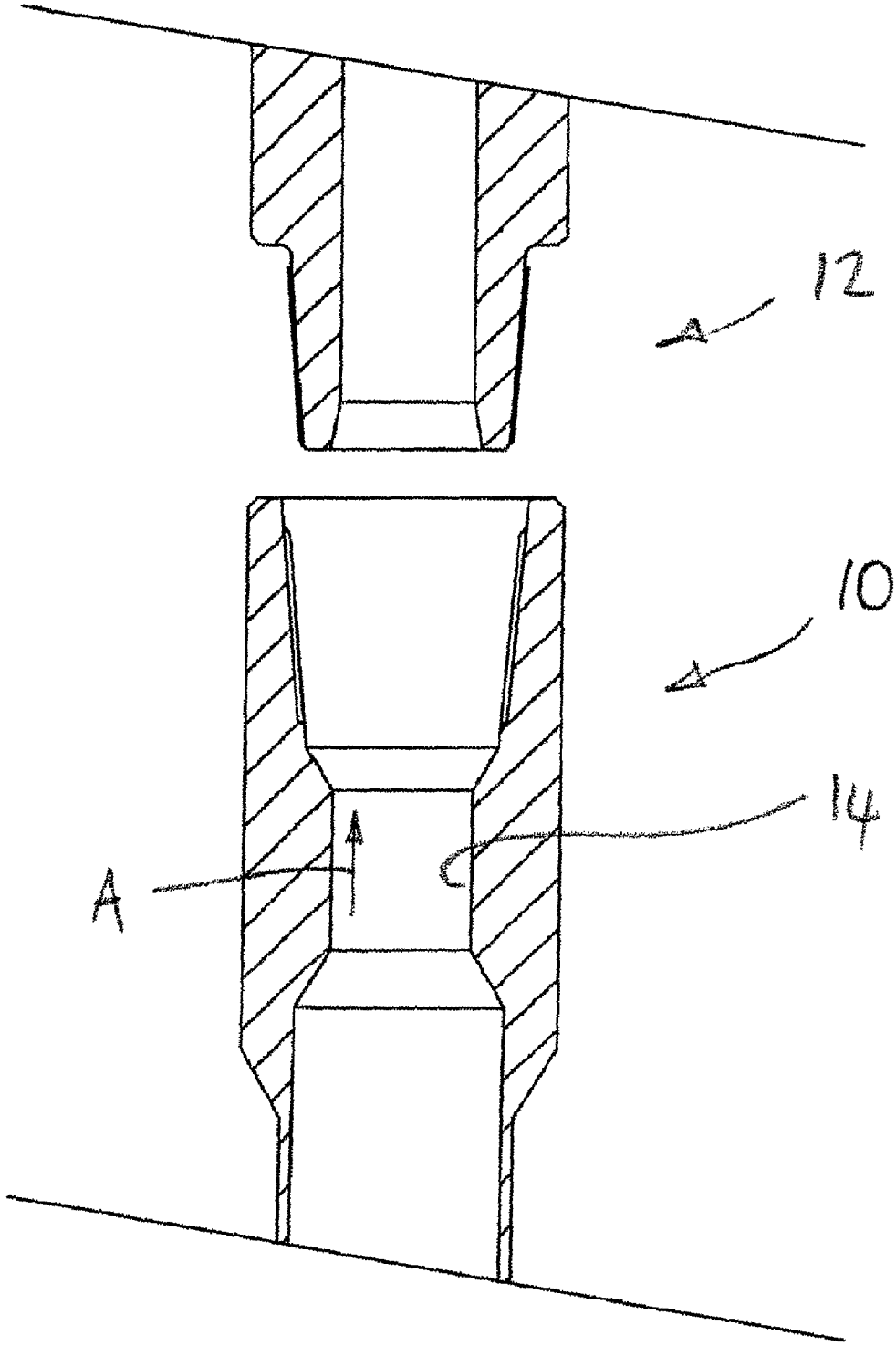
FIG. 1 is a sectional representation of the upper end of a drill string and part of a top drive.

FIG. 1 shows the upper end of a drill pipe section 10 which forms the upper end portion of a drill pipe string. Above the drill pipe section 10 is the male threaded coupling portion of a top drive 12. When making up a drill string, slips in the drill table or deck support the upper end of the drill string. Elevators mounted to the top drive are utilised to lift a stand of drill pipe, consisting of three drill pipe sections, from a rack. The elevator locates the pipe stand above the upper end of the string. The pulley-mounted top drive is lowered to engage the threaded pin connection on the lower end of the pipe stand with the threaded box connection at the upper end of the string. The pipe stand is then rotated to engage the threads. Once the threads have fully engaged the slips may be released and the drill string, now incorporating the new pipe stand, may be suspended from the elevators, and lowered into the bore until the upper end of the new stand is located just above the drill table. The slips are then actuated to engage the upper end of the stand. Where the drill pipe string is not self-filling, the drill string must be periodically top-filled with fluid to prevent hydrostatic pressure in the bore collapsing the upper air-filled portion of the string. Top filling is typically carried out every ten stands, that is approximately every 950 feet. At present this is achieved by locating the top drive coupling 12 and the upper end of the drill string stand as illustrated in FIG. 1, and allowing drilling fluid to flow at a low flow rate (no more than 80 gallons/min) from the top-drive coupling 12 into the upper open end of the string.

The presence of the narrow throat 14 in the drill pipe 10, with an internal diameter typically between 3 and 3½", tends to limit the rate at which the fluid flows into the pipe without splashing and spilling, the oppositely directed flow of air (arrow A) being displaced from the pipe string tending to disrupt the flow of drilling fluid into the string.

Figure 2:
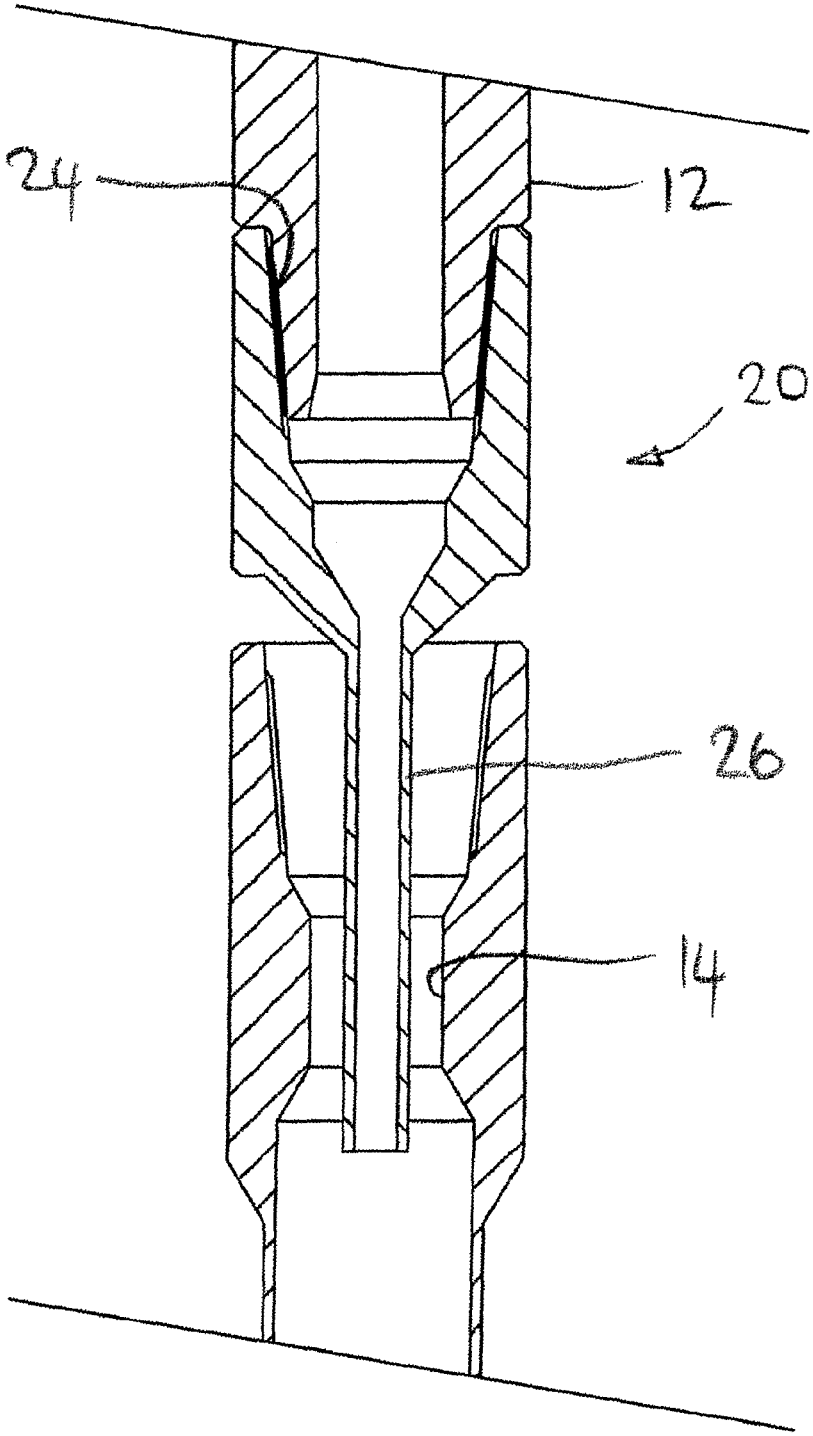
FIGS. 2, 3, 4 and 5 are sectional representations of top-filling apparatus in accordance with three different embodiments of the present invention.

Reference is now made to FIG. 2 of the drawings, which illustrates apparatus 20 in accordance with a first embodiment of the present invention. The apparatus comprises a nozzle fitting 20 adapted to be mounted to the male coupling of a top drive 12. The fitting 20 is hollow and defines a female threaded portion 24 for engaging the top drive coupling 12. An elongate spout 26 defining a relatively small diameter extends from the threaded portion 24. The spout 26 is of sufficient length such that, in use, as illustrated in FIG. 2, with the fitting 20 mounted to the top drive coupling 12 and extending into the upper end of the pipe string, the spout 26 may extend through the pipe throat 14 and into the larger diameter portion of the pipe bore beyond the throat 14.

In use, during running in a drill string that requires top filling, the fitting 20 is coupled to the top drive coupling 12 when it is determined that top-filling is required or desirable and the top drive lowered relative to the upper end of the pipe string to locate the spout 26 as illustrated in FIG. 2. As noted above this will typically be after ten stands of drill pipe, having a length of approximately 950 feet, have been run into the bore. The internal volume of the ten pipe stands may be readily calculated, and the drilling fluid pumps which are coupled to the top drive may be run for the number of strokes required to pump that volume of fluid. The pumps may be run at a relatively high rate, typically about 800 gallons/min such that the ten stands of pipe will typically be filled in approximately one minute. Of course lower flow rates may be utilised if desired, but the time taken to fill the drill stands will increase proportionally.

Once the fluid has been pumped into the drill string the top drive is raised to retract the spout from the upper end of the drill string. The fitting 20 may be removed, or may remain on the top drive coupling 12, ready for the next top-filling operation, if the top drive coupling 12 is not required for other purposes.

Figure 3:
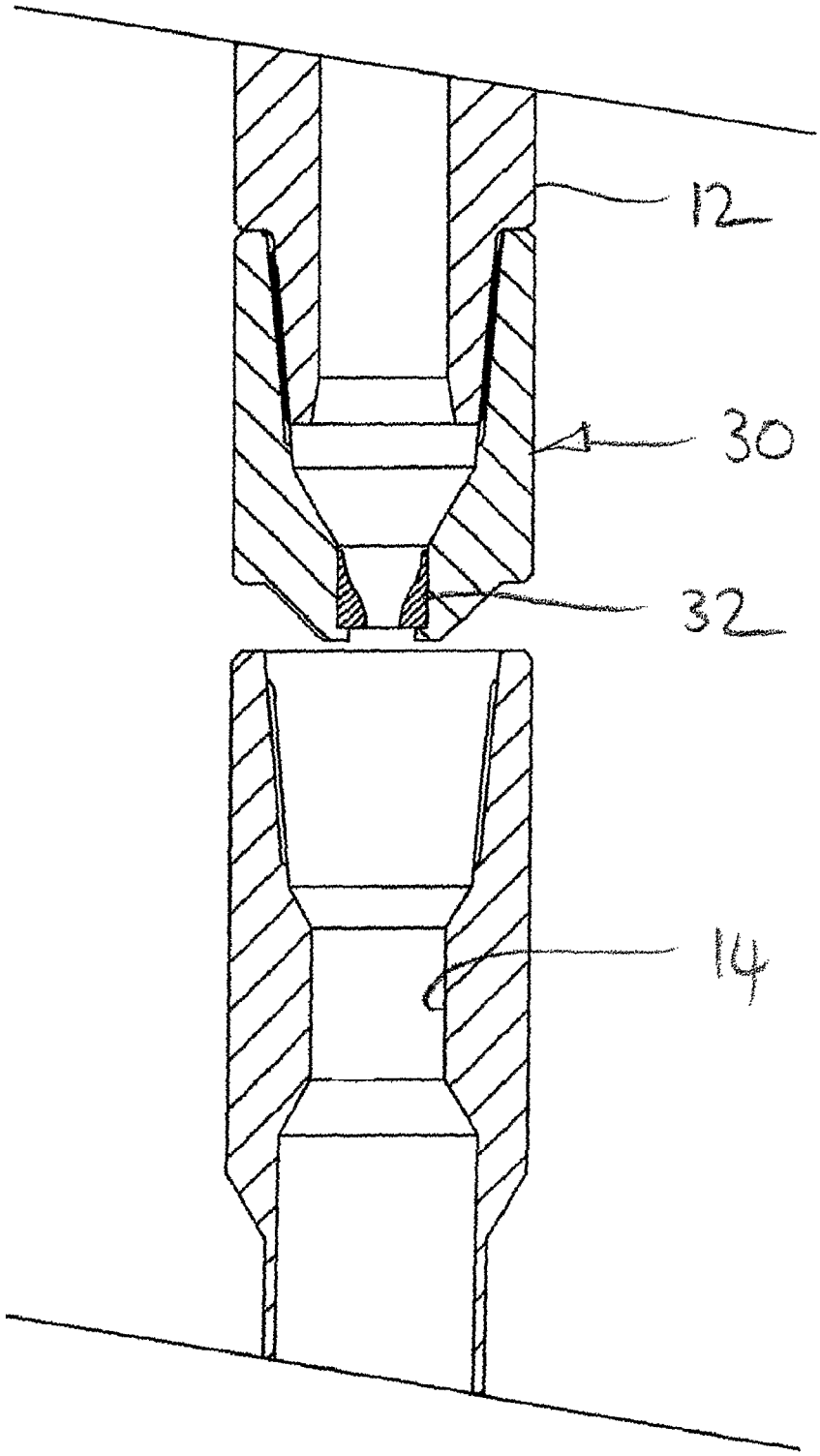

Reference is now made to FIG. 3 of the drawings, which illustrates an alternative top-filling apparatus, in the form of a nozzle fitting 30 adapted to be coupled, via a female thread, with a top drive coupling 12. The fitting 30 comprises a nozzle insert 32 such that when fluid is pumped through the fitting 30 at a relatively high rate the fluid exits the insert 32 as a well-defined liquid jet. Thus, with the fitting 30 located just above and spaced from the upper end of the pipe string, the jet of fluid may pass through the pipe throat 14 without disruption, allowing rapid filling of the string.

Figure 4:
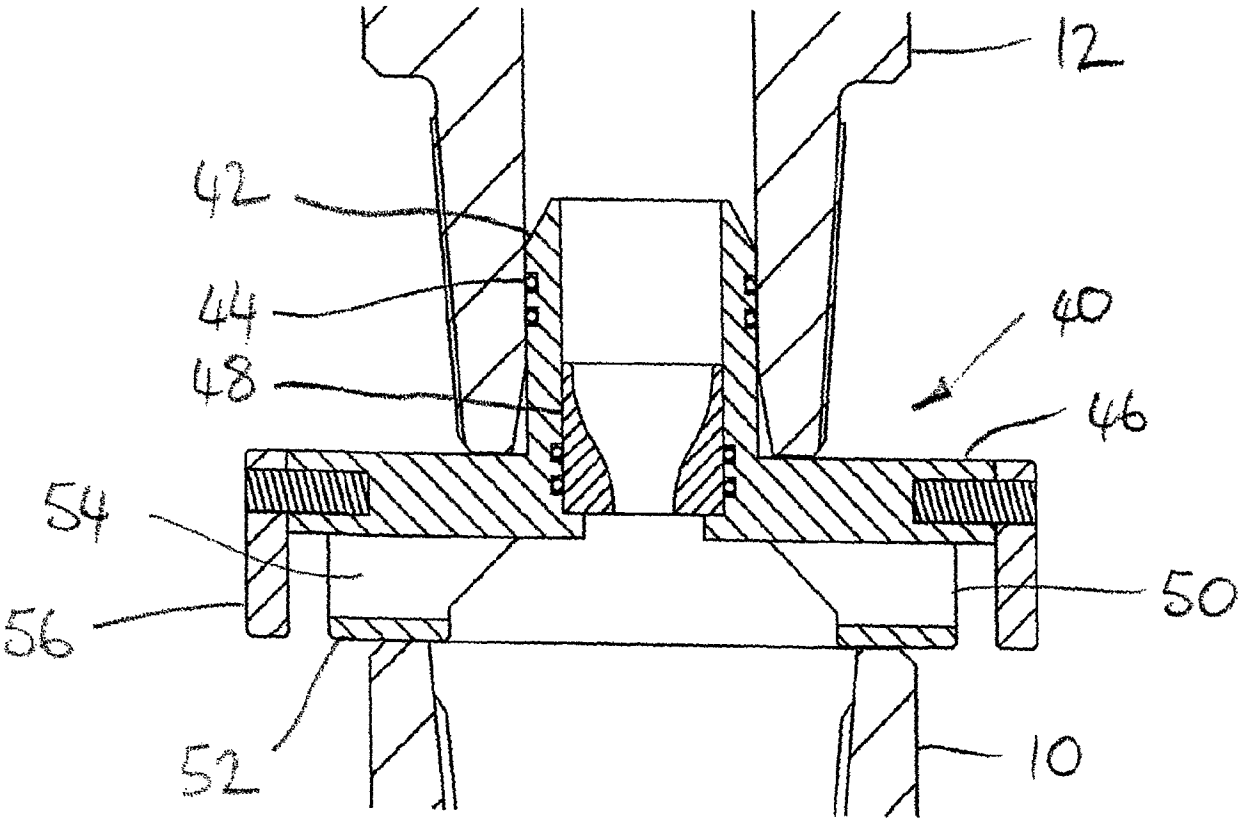

Reference is now made to FIG. 4 of the drawings, which illustrates apparatus in accordance with a further, embodiment of the present invention. The apparatus comprises a fitting 40 adapted to be fixed relative to the top drive coupling 12 by trapping the fitting 40 between the top drive coupling 12 and the upper end of the pipe string 10. The fitting 40 comprises a male boss 42 provided with external seals 44 and adapted for sealing location within the end of the top drive coupling 12. The boss 42 extends upwardly from the centre of a circular body 46 which accommodates a nozzle insert 48. The body 46 has a lower annular face 52 for resting on the upper end of the pipe string and also defines a plurality of radial airflow passages 54. A skirt 56 depends from the circumferential edge of the flange 46 across the outlets of the airflow passages 54.

In use, when it is desired to top fill a drill pipe stand, the fitting 40 will be centrally located on the upper end of the pipe string, which will be held by the slips just above the drill table. The top drive is then lowered slowly, such that the coupling 12 passes over the boss 42, until the lower end of the coupling 12 comes to rest on the upper face of the flange 46. The predetermined volume of fluid is then pumped through the top drive and into the pipe string, the fluid exiting the top drive and fitting 40 as a well-defined jet which passes through the upper drill pipe throat. Air displaced by the fluid may pass through the airflow passages 54.

When the pipe string has been filled, the top drive is raised, allowing the fitting 40 to be pulled from the top drive coupling 12 if desired. The absence of any threaded connection between the fitting 40 and the coupling 12 allows the fitting 40 to be mounted to the coupling 12 and removed from the coupling 12 relatively quickly.

Figure 5:
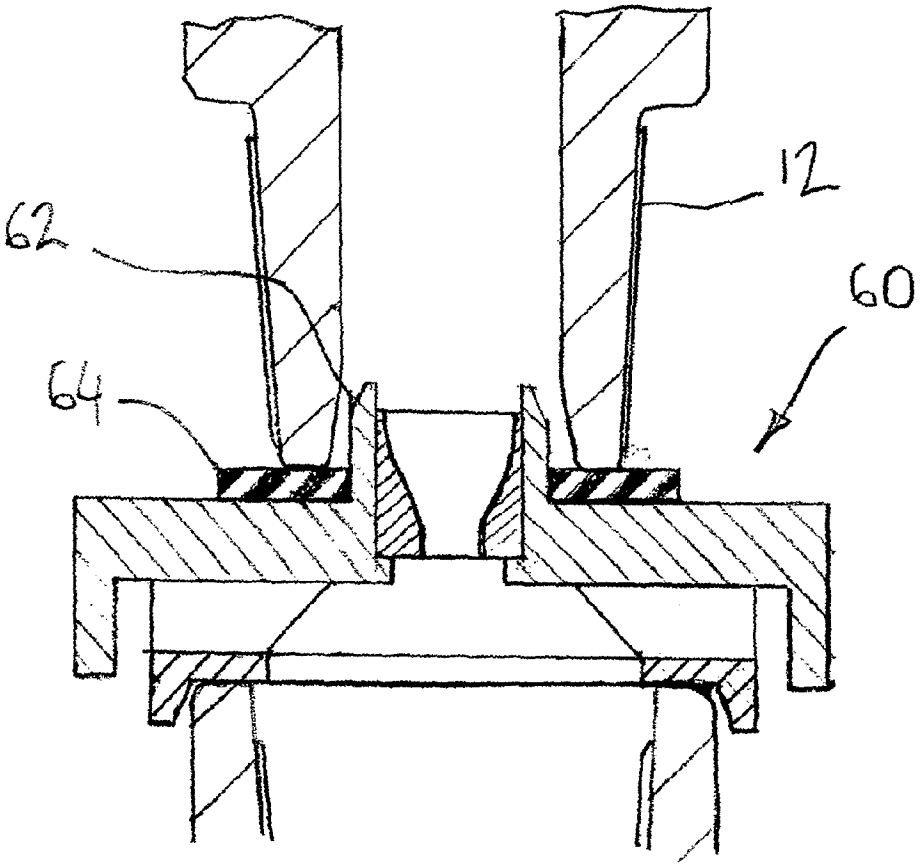

Reference is now made to FIG. 5 of the drawings, which illustrates top-filling apparatus in accordance with a preferred embodiment of the invention. The apparatus comprises a fitting 60 which operates in a manner somewhat similar to the fitting 40 described above.

However, in the fitting 60 the male boss 62 is sized to be smaller than the female portion of the top drive coupling 12, and in practice is not intended to contact the inner surface of the top drive. Sealing between the fitting 60 and the top drive 12 is achieved by provision of a relatively thick rubber gasket 64 at the base of the boss 62, against which the end of the coupling 12 presses.

To facilitate location of the fitting 60 on the upper end of the string the lower face of the fitting 60 is chamfered, such that the fitting 60 is self-centering on the string.

When it is desired to top-fill a drill pipe string section, operators locate the fitting 60 on the box connection at the upper end of the string. The top drive is then lowered such that the boss 62 passes into the coupling 12 and the lower end of the coupling comes to rest on the gasket 64. At least a portion of the weight of the top drive is allowed to rest on the gasket 64, to ensure a fluid-tight seal.

Following the filling of the string, the top drive is raised, leaving the fitting 60 sitting on the box connection, ready to be lifted off by the operators.

From the above description it will be noted that the various embodiments of the invention provide a convenient arrangement for top-filling a drill pipe string. The ability to top fill the drill string relatively quickly will allow, for example, a 10,000 foot drill string to be made up 1 to 1½ hours more quickly than using conventional top fill methods. At a rig rental rate of $10,000 per hour, this represents a significant saving for the operator.

Those of skill in the art will recognise that the above-described embodiments are merely exemplary of the present invention and that various modifications and improvements may be made thereto, without departing from the scope of the invention. For example, while reference is made above primarily to the top filling of drill pipe, the methods and apparatus of the present invention may find utility in top filling other tubing forms.

The invention claimed is:

1. A method of top-filling a drill pipe string, the method comprising:

injecting fluid through an injector into the upper end of the drill pipe string;

controlling the flow of air displaced from the drill pipe string during top filling of the drill pipe string; and constraining the flow of air displaced from the drill pipe string to a predetermined path, wherein the predetermined path is in a downward direction relative to the pipe string.

2. The method of claim 1, wherein the fluid is injected in at least one relatively high velocity streams having a cross-sectional area significantly smaller than the smallest restriction at the upper end of the drill pipe string.

3. The method of claim 1, wherein one of a fluid jet and curtain is configured to flow down the wall of the drill pipe.

4. The method of claim 1, wherein the injected fluid configuration is selected such that air displaced from the drill string may pass readily through the open upper end of the string without disrupting the flow of injected fluid into the string.

5. The method of claim 1, wherein the volume of fluid necessary to fill the drill string to a desired level is determined, and the determined volume of fluid pumped into the string.

6. The method of claim 1, wherein constraining the flow of air displaced from the drill pipe string to a predetermined path further comprises constraining the flow of air into at least one air flow passage and depending skirt.

7. Apparatus for use in top-filling a drill pipe string, the apparatus comprising:

an injector adapted to co-operate with an upper end of a drill pipe string, whereby fluid may be pumped through the injector and into the drill pipe string; and a nozzle adapted to form a jet of fluid to be directed into the drill pipe string and wherein the nozzle has an outlet adapted for one of: location above and adjacent an open upper end of the drill pipe string.

8. The apparatus of claim 7, including a fluid guide configured for extending into an upper end of a string.

9. The apparatus of claim 8, wherein the guide comprises one of a tube and spout.

10. The apparatus of claim 9, wherein the tube is of sufficient length to extend through one of a throat and restriction present towards the end of a section of a drill pipe.

11. The apparatus of claim 9, wherein the tube is adapted to be located centrally of a drill string.

12. The apparatus of claim 7, configured to direct fluid downwards in an axial direction, parallel to a drill string axis.

13. The apparatus of any of claim 7, configured to direct fluid in a flow path inclined to a drill string axis.

14. The apparatus of claim 13, wherein the apparatus is configured to direct fluid in a flow path such that the fluid flows downwards following a helical path around an upper surface of a drill string.

15. The apparatus of claim 7, adapted for mounting to one of: a top drive apparatus and other structure.

16. The apparatus of claim 15, adapted for mounting to and demounting from a top drive.

17. The apparatus of claim 15, wherein the apparatus defines one of a female thread and other thread-engaging arrangement for co-operation with a male threaded portion of a top drive.

18. The apparatus of claim 7, adapted to be fixed in location at an upper end of a drill string by one of trapping and securing at least a part of the apparatus between a top drive and an upper end of an drill pipe string.

19. The apparatus of claim 7, comprising a body and a sealing element adapted to be located between a top drive and the body.

20. The apparatus of claim 19, wherein the sealing element is adapted to be compressed between a top drive and the body.

21. The apparatus of claim 7, wherein the apparatus is adapted to be one of: deck-mounted; provided on a unit adapted to be fixed on the rig; and or a deck-mounted unit.

22. The apparatus of claim 7, wherein the apparatus is adapted for use without requiring one of coupling and positive engagement with a drill string.

23. The apparatus according to claim 7 wherein the apparatus is configured to control the flow of air displaced from a drill pipe string during top filling of a drill pipe string.

24. The apparatus according to claim 23 wherein the apparatus is configured to constrain flow of air displaced from the drill pipe to a predetermined path.

25. A method comprising:

locating a drill pipe string top filling apparatus at an upper end of a drill pipe string;

securing at least a part of the drill pipe string top filling apparatus between a top drive and the upper end of the drill pipe string;

pumping fluid into the drill pipe string through the drill pipe string top filling apparatus;

controlling the flow of air displaced from the drill pipe string during top filling of the drill pipe string; and constraining the flow of air displaced from the drill pipe string to a predetermined path, wherein the predetermined path is in a downward direction relative to the pipe string.

26. The method of claim 25, wherein constraining the flow of air displaced from the drill pipe string to a predetermined path further comprises constraining the flow of air into at least one air flow passage and depending skirt.

27. Apparatus comprising a resting face, the resting face configured to provide for resting of the apparatus on an upper end of a drill pipe string, the apparatus further comprising an upper face configured to provide for trapping of the apparatus between a top drive and a drill pipe string.

28. Apparatus for use in top-filling a drill pipe string, the apparatus comprising:

an injector adapted to co-operate with an upper end of the drill pipe string, whereby fluid may be pumped through the injector and into the drill pipe string and wherein the apparatus is adapted for mounting to one of: a top drive apparatus and other structure; and a male portion for extending into the open end of the top drive apparatus.

29. Apparatus for use in top-filling a drill pipe string, the apparatus comprising:

an injector adapted to co-operate with an upper end of the drill pipe string, whereby fluid may be pumped through the injector and into the drill pipe string wherein the apparatus is adapted for use without requiring one of coupling and positive engagement with a drill string; and wherein the apparatus is adapted for use without the apparatus contacting the drill pipe string.

30. Apparatus for use in top-filling a drill pipe string, the apparatus comprising:

an injector adapted to co-operate with an upper end of the drill pipe string, whereby fluid may be pumped through the injector and into the drill pipe string, wherein the apparatus is configured to control the flow of air displaced from the drill pipe string during top filling of the drill pipe string;

wherein the apparatus is configured to constrain flow of air displaced from the drill pipe string to a predetermined path; and air flow passage(s) and depending skirt to provide for controlling of the flow of air displaced from the drill pipe string in a downwardly direction, relative to the drill pipe string.

31. Apparatus for use in top-filling a drill pipe string, the apparatus comprising:

an injector adapted to co-operate with the upper end of the drill pipe string, whereby fluid may be pumped through the injector and into the drill pipe string, wherein the apparatus is configured to control the flow of air displaced from the drill pipe string during top filling of the drill pipe string; and wherein the apparatus is configured to constrain flow of air displaced from the drill pipe string to a predetermined path in a downwardly direction, relative to the pipe string.

* * * * *